US010054356B2

(12) United States Patent
Lee

(10) Patent No.: US 10,054,356 B2
(45) Date of Patent: Aug. 21, 2018

(54) FAN-MOTOR ASSEMBLY INCLUDING SUPPORT PLATE TO SUPPORT FAN AND MOTOR AND REFRIGERATOR INCLUDING THE FAN-MOTOR ASSEMBLY

(71) Applicant: LG ELECTRONICS INC., Seoul (KR)

(72) Inventor: Bongkook Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 268 days.

(21) Appl. No.: 14/978,739

(22) Filed: Dec. 22, 2015

(65) Prior Publication Data

US 2016/0178265 A1 Jun. 23, 2016

(30) Foreign Application Priority Data

Dec. 23, 2014 (KR) ..... 10-2014-0187460

(51) Int. Cl.
*F25D 17/06* (2006.01)
*F04D 25/08* (2006.01)
(Continued)

(52) U.S. Cl.
CPC ..... *F25D 17/062* (2013.01); *F04D 25/06* (2013.01); *F04D 25/068* (2013.01);
(Continued)

(58) Field of Classification Search
CPC .... F25D 17/062; F25D 23/006; F25D 17/065; F25D 17/067; F25D 2317/0681;
(Continued)

(56) References Cited

U.S. PATENT DOCUMENTS 4,634,341 A * 1/1987 Monroe ..... F01D 7/00 415/129
5,895,994 A 4/1999 Molnar et al.
(Continued)

FOREIGN PATENT DOCUMENTS

JP 2007-107732 4/2007
JP 2010-022168 1/2010
(Continued)

OTHER PUBLICATIONS

Extended European Search Report issued in European Application No. 15201434.6 dated May 20, 2016, 8 pages.
(Continued)

*Primary Examiner* — Dominick L Plakkoottam
*Assistant Examiner* — Stephen Mick
(74) *Attorney, Agent, or Firm* — Fish & Richardson P.C.

(57) ABSTRACT

A refrigerator that includes a fan including a hub and a plurality of blades, the hub having a first accommodation space and the plurality of blades being disposed outside the hub; a motor including a stator and a rotor, the motor located in a case, the case having a cylindrical shape and being disposed in the hub, the stator being disposed in the case, and the rotor having a rotational shaft coupled to the hub and being rotatably disposed in the stator; and a support plate that is coupled to the case and that is configured to support the fan and the motor is disclosed.

18 Claims, 7 Drawing Sheets

(51) Int. Cl.
*F04D 25/06* (2006.01)
*F25D 23/00* (2006.01)

(52) U.S. Cl.
CPC ..... *F04D 25/0613* (2013.01); *F04D 25/0646* (2013.01); *F04D 25/08* (2013.01); *F25D 17/065* (2013.01); *F25D 17/067* (2013.01); *F25D 23/006* (2013.01); *F25D 2317/0681* (2013.01)

(58) Field of Classification Search
CPC ..... F04D 25/06; F04D 25/068; F04D 25/08; F04D 25/0613; F04D 25/0646
USPC ..... 417/423.7

See application file for complete search history.

(56) References Cited

U.S. PATENT DOCUMENTS

| | | | | |
|---|---|---|---|---|
| 2009/0091137 | A1* | 4/2009 | Nishida | F02B 63/04 290/1 R |
| 2009/0185919 | A1* | 7/2009 | Yoo | F04D 25/0613 417/354 |
| 2012/0039729 | A1 | 2/2012 | Horing et al. | |

FOREIGN PATENT DOCUMENTS

| | | |
|---|---|---|
| KR | 20-2009-0000907 | 2/2009 |
| KR | 10-2009-0080425 | 7/2009 |
| KR | 10-2014-0123814 | 10/2014 |
| TW | 201107609 | 3/2011 |

OTHER PUBLICATIONS

Office Action issued in Korean Application No. 10-2014-0187460 dated Feb. 16, 2016, 7 pages.

* cited by examiner

FAN-MOTOR ASSEMBLY INCLUDING SUPPORT PLATE TO SUPPORT FAN AND MOTOR AND REFRIGERATOR INCLUDING THE FAN-MOTOR ASSEMBLY

CROSS-REFERENCE TO RELATED APPLICATION

Pursuant to 35 U.S.C. § 119(a), this application claims the benefit of earlier filing date and right of priority to Korean Application No. 10-2014-0187460, filed on Dec. 23, 2014, the contents of which is incorporated by reference herein in its entirety.

TECHNICAL FIELD

The present disclosure generally relates to a fan-motor assembly and a refrigerator including the fan-motor.

BACKGROUND

A refrigerator is an apparatus keeping foods fresh using cold air generated by a refrigeration cycle. For example, a refrigerator may include a compressor, a condenser, an expansion valve, and an evaporator.

A fan-motor assembly is an apparatus facilitating the air circulation inside a refrigerator

SUMMARY

In general, one aspect of the subject matter described in this specification may be embodied in a refrigerator that includes a fan including a hub and a plurality of blades, the hub having a first accommodation space and the plurality of blades being disposed outside the hub; a motor including a stator and a rotor, the motor located in a case, the case having a cylindrical shape and being disposed in the hub, the stator being disposed in the case, and the rotor having a rotational shaft coupled to the hub and being rotatably disposed in the stator; and a support plate that is coupled to the case and that is configured to support the fan and the motor. The case includes a first body; a second body coupled to the first body in an axial direction and configured to define a second accommodation space in the second body, the second body contacting a surface of the first body; and coupling rods protruding from one of the first body and the second body, the coupling rods being coupled to the other of the first body and the second body through the stator. Each of the coupling rods protrudes from the first body and is inserted into the second body, and wherein the second body is provided with a coupling portion, the coupling portion allowing the second body to be coupled to the coupling rods. The coupling portion includes melted portions of the second body at which end portions of the coupling rods are melted onto the second body for coupling. The first body is disposed at an open side of the hub, and wherein the first body and the support plate are provided with an engagement portion by which the first body and the support plate are engaged with each other in an axial direction. The engagement portion includes a protrusion protruding from one of the first body and the support plate; and a protrusion accommodating portion located at the other of the first body and the support plate such that the protrusion is inserted into the protrusion accommodating portion. The first body further includes a coupling portion coupled to the support plate. Each of the first body and the second body includes stator supporting portions, the stator supporting portions being respectively in contact with an edge of the stator to support the stator. The stator supporting portions protrude from inner surfaces of the first body and the second body, respectively, and extend along a circumferential direction of the first body and the second body. The case is provided with a bearing to support the rotational shaft. The assembly further includes a printed circuit board provided in the case, and having a control circuit configured to control a rotation of the rotor. The stator includes a stator core defining, in the stator core, a rotor accommodation space in which the rotor is inserted, and having a plurality of poles and slots protruding toward the rotor accommodating space; and stator coils wound on circumferences of the poles, respectively, wherein coupling rods are inserted into empty spaces between adjacent stator coils, and wherein the printed circuit board is disposed between the stator core and the case. The printed circuit board is provided with coupling rod accommodating holes through which the coupling rods are inserted. The assembly further includes fixing portions to fix the stator and the printed circuit board. Each of the fixing portions includes a fixing pin provided at the stator core; a fixing pin hole located at the printed circuit board and configured to receive the fixing pin; and a bonded portion located at an end portion of the fixing pin and inserted in the fixing pin hole.

Another aspect of the subject matter described in this specification may be embodied in a refrigerator that includes a refrigerator main body having a storage chamber; a cool air circulation passage along which cool air of the storage chamber circulates; and a fan-motor assembly circulating the cool air, wherein the fan-motor assembly includes a fan including a hub and a plurality of blades, the hub having a first accommodation space and the plurality of blades being disposed outside the hub; a motor including a stator and a rotor, the motor located in a case, the case having a cylindrical shape and being disposed in the hub, the stator being disposed in the case, and the rotor having a rotational shaft coupled to the hub and being rotatably disposed in the stator; and a support plate that is coupled to the case and that is configured to support the fan and the motor. The case includes a first body; a second body coupled to the first body in an axial direction and configured to define a second accommodation space in the second body, the second body contacting a surface of the first body; and coupling rods protruding from one of the first body and the second body, the coupling rods being coupled to the other of the first body and the second body through the stator. Each of the coupling rods protrudes from the first body and is inserted into the second body, and wherein the second body is provided with a coupling portion, the coupling portion allowing the second body to be coupled to the coupling rods. The coupling portion includes melted portions of the second body at which end portions of the coupling rods are melted onto the second body for coupling. The first body is disposed at an open side of the hub, and wherein the first body and the support plate comprise an engagement portion to be engaged with each other in an axial direction.

The details of one or more examples of the subject matter described in this specification are set forth in the accompanying drawings and the description below. Other potential features, aspects, and advantages of the subject matter will become apparent from the description, the drawings, and the claim.

DETAILED DESCRIPTION

Figure 1:
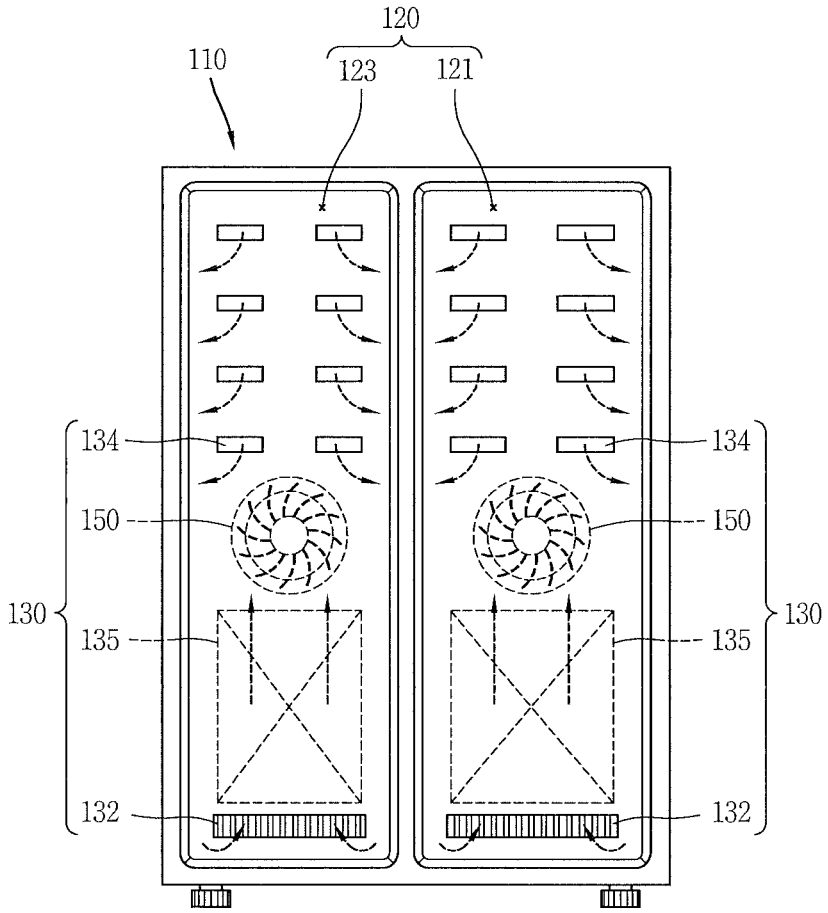
FIG. 1 is a diagram illustrating an example refrigerator having a fan-motor assembly.
Figure 2:
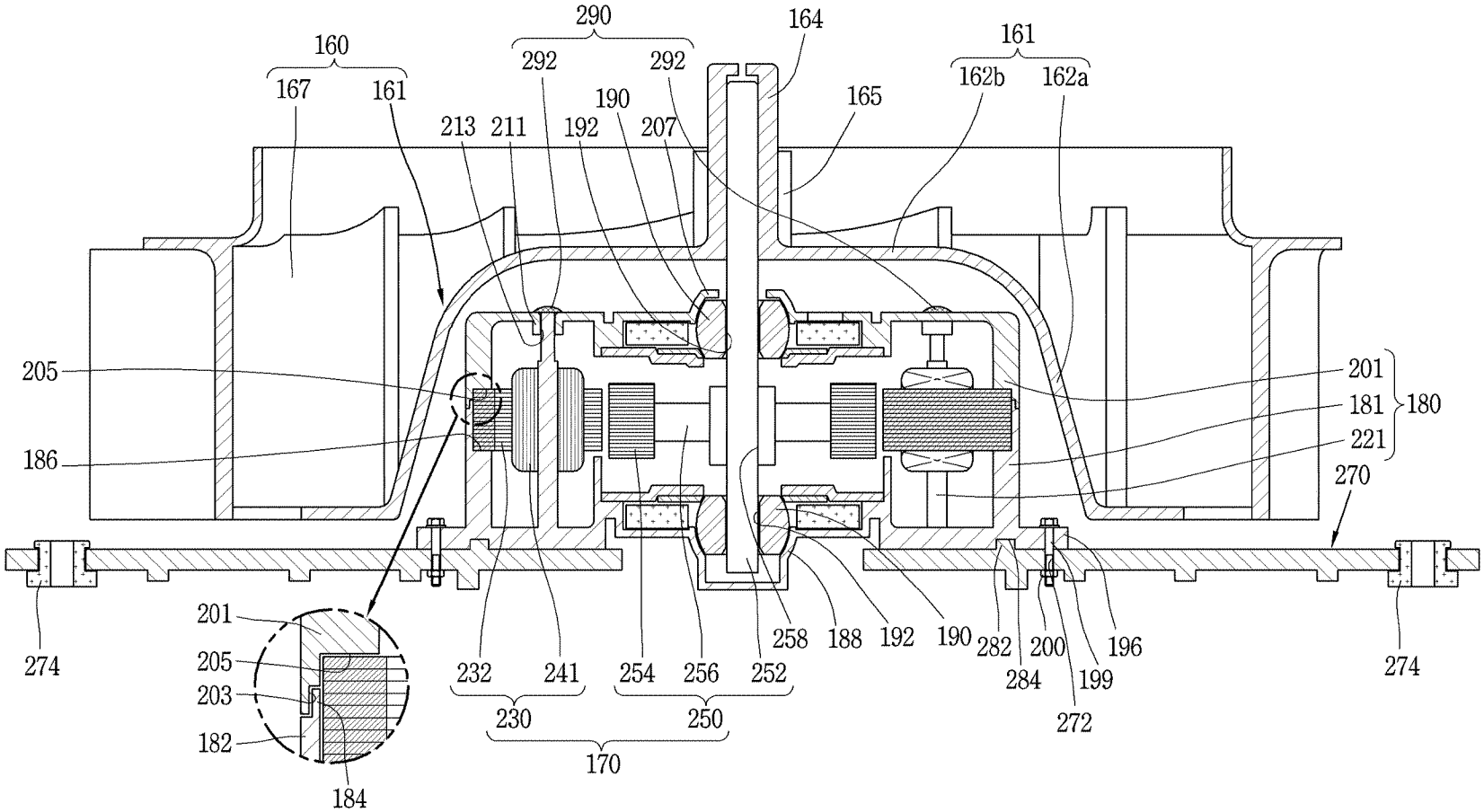
FIG. 2 is a diagram illustrating an example fan-motor assembly.

FIG. 1 illustrates an example refrigerator having a fan-motor assembly and FIG. 2 illustrates an example fan-motor assembly. A refrigerator having a fan-motor assembly may include a refrigerator main body 110 having a storage chamber 120, a cool air circulation passage 130 through which cool air of the storage chamber 120 circulates, and a fan-motor assembly 150 provided in the cool air circulation passage 130 to allow for the circulation of the cool air.

The storage chamber 120 may be formed in the refrigerator main body 110.

A door for opening and closing the storage chamber 120 may be provided at the refrigerator main body 110.

The storage chamber 120, for example, may be provided in plurality configured to be arranged in left and right directions of the refrigerator main body 110.

The storage chamber 120, for example, may include a freezing chamber 121 and a refrigerating chamber 123.

In some implementations, the refrigerator can be a side-by-side refrigerator in which the freezing chamber 121 and the refrigerating chamber 123 of the refrigerator main body 110 are disposed in left and right directions of the refrigerator main body 110. In some other implementations, the refrigerator can be a top mount type refrigerator in which the freezing chamber and the refrigerating chamber are disposed up and down, or a so-called bottom freezer type refrigerator in which the refrigerating chamber and the freezing chamber are disposed up and down.

The refrigerator main body 110, for example, may include the cool air circulation passage 130 through which air of the storage chamber 120 circulates.

The cool air circulation passage 130 may be provided with a cool air introduction opening 132 through which cool air is introduced, and a cool air discharge opening 134 through which cool air is discharged.

The cool air introduction opening 132, for example, may be located at a lower portion of the storage chamber 120.

The cool air discharge opening 134, for example, may be located at an upper portion of the storage chamber 120.

The cool air circulation passage 130, for example, may be provided with an evaporator 135 therein for cooling air flowing therethrough in a heat-exchanging manner.

In some implementations, the cool air circulation passage 130 is independently provided in each of the freezing chamber and the refrigerating chamber such that air can independently flow and be cooled. However, the cool air circulation passage 130 may also be configured such that an evaporator is installed only in the freezing chamber and cool air passed through the evaporator is discharged to the freezing chamber and/or refrigerating chamber.

Meanwhile, the cool air circulation passage 130 may be provided with a fan-motor assembly for facilitating a circulation of air.

The fan-motor assembly 150, for example, may include a fan 160 provided with a hub 161 having an accommodation space therein, and a plurality of blades 167 disposed at an outer side of the hub 161, a motor 170 provided with a case 180 formed in a cylindrical shape and accommodated in the hub 161, a stator 230 disposed in the case 180, and a rotor 250 having a rotational shaft 252 with one side coupled to the hub 161 and rotatably disposed in the stator 230, and a support plate 270 coupled to the case 180 to support the fan 160 and the motor 170.

The fan 160, for example, may be configured as a centrifugal fan by which air is sucked in an axial direction and discharged in a radial direction.

The fan 160 may include a hub 161 having an accommodation space defined therein, and a plurality of blades 167 disposed at an outer side of the hub 161.

Here, the fan 160, for example, may be configured as a turbo fan having the blades 167 which are disposed at a circumference of the hub 161 in a radial direction and spaced apart from one another in a circumferential direction.

The hub 161, for example, may be formed in a shape of a cup with one side open.

The hub 161 may be configured such that its outer width is gradually increasing toward the open side.

The hub 161, for example, may be provided with a circumferential section 162*a*, and a blocking section 162*b* which blocks an end portion of the circumferential section 162*a*.

The blocking section 162*b* may be formed in a shape of a circular plate.

Here, the blocking section 162*b* may be disposed perpendicular to the rotational shaft 252.

One side of the circumferential section 162*a* may have a section shape which is curved such that an inner diameter thereof is gradually increasing from the blocking section 162*b*.

The other side of the circumferential section 162*a* may have a shape of a plate which is curved to be perpendicular to the rotational shaft 252.

The hub 161, for example, may be provided with a shaft accommodating portion 164 in which the rotational shaft 252 of the motor 170 to be explained later is inserted.

The shaft accommodating portion 164, for example, may protrude from a center of the blocking section 162*b* in an axial direction.

The shaft accommodating portion 164 may protrude to outside of the hub 161.

A pressing member 165 for pressing the shaft accommodating portion 164 such that the shaft accommodating portion 164 is closely adhered onto the rotational shaft 252 of the motor 170 may be provided at an outer side of the shaft accommodating portion 164.

The pressing member 165, for example, may be configured as a spring (coil spring).

The motor 170, for example, may include a case 180 formed in a cylindrical shape and accommodated in the hub 161, a stator 230 disposed in the case 180, and a rotor 250 having the rotational shaft 252 with one side coupled to the hub 161 and rotatably disposed in the stator 230.

The case 180 may be formed in a cylindrical shape.

The case 180 may be concentrically disposed with the hub 161.

This may result in a reduction of a gap between an inner surface of the hub 161 and an outer surface of the case 180.

With the configuration, supposing the same size of the hub 161, a real size of the case 180 may increase and a size of the motor 170 accommodated in the case 180 may increase, thereby raising an output of the motor 170.

The stator 230 may include a stator core 232 having an accommodation space in which the rotor 250 is accommodated, and a stator coil 241 wound on the stator core 232.

The stator core 232, for example, may include a yoke 233 in a circular shape, a plurality of poles 234 protruding from an inner surface of the yoke 233 toward a center and spaced apart from one another along a circumferential direction, and slots 235 disposed between adjacent poles 234.

The stator coil 241, for example, may be wound on a circumference of each pole 234 in a concentrated manner.

The stator coil 241 may be provided with a plurality of coil portions 243 wound on the circumferences of the respective poles.

An empty space of the slot 235 may be formed between the adjacent coil portions 243.

Each coil portion 243, for example, is formed with almost the same width at the circumference of each pole 234. Accordingly, a width of the empty space of the slot 235 may increase toward the yoke 233 in a radial direction.

The stator 230 may include an insulator 247 which is coupled to the stator core 232 before winding the stator coil 241.

The insulator 247 may be formed of an electric insulating member.

The formation of the insulator 247 may allow the stator core 232 and the stator coil 241 to be insulated from each other.

The insulator 247 may be formed of a synthetic resin member.

The insulator 247 may be formed by injection molding.

The insulator 247, for example, may be coupled to both sides of the stator core 232 in an axial direction.

The insulator 247, for example, may be configured to cover circumferential surfaces of the poles 234, an inner surface of the yoke 233, and upper and lower surfaces of the yoke 233.

The rotor 250, for example, may include a rotational shaft 252 and a permanent magnet 254 which rotates centering on the rotational shaft 252.

The permanent magnet 254, for example, may be formed in a cylindrical shape.

The rotor 250, for example, may be provided with a frame 256 coupled to an inner side of the permanent magnet 254.

The frame 256 may be provided with a rotational shaft coupling portion 258 to which the rotational shaft 252 can be coupled.

The rotational shaft 252, for example, may have one side coupled to the frame 256 and another side connected to the fan 160.

The rotational shaft 252 may be fixedly coupled to the shaft accommodating portion 164.

Accordingly, a rotational force of the rotor 250 may be transferred to the fan 160 such that the fan 160 can rotate along with the rotational shaft 252.

The support plate 270, for example, may be formed in a shape of a plate.

The support plate 270, for example, may be formed in a shape of a rectangular plate.

The support plate 270 may include through holes 272 through which coupling members (screws or bolts) 199 are inserted via the case 180.

The support plate 270 may be coupled to a desired object (e.g., the cool air circulation passage 130) by coupling members.

The support plate 270, for example, may include an anti-vibration member (anti-vibration rubber) 274 which prevents vibration from being transferred to the desired object.

Meanwhile, the fan-motor assembly 150 may include a printed circuit board 260 having a control circuit for controlling a rotation of the rotor 250.

The printed circuit board 260 may be provided in the case 180.

The printed circuit board 260, for example, may be disposed between the case 180 and the stator 230.

The printed circuit board 260, for example, may be provided at one side (a lower side, in the drawing) of the stator 230.

Figure 3:
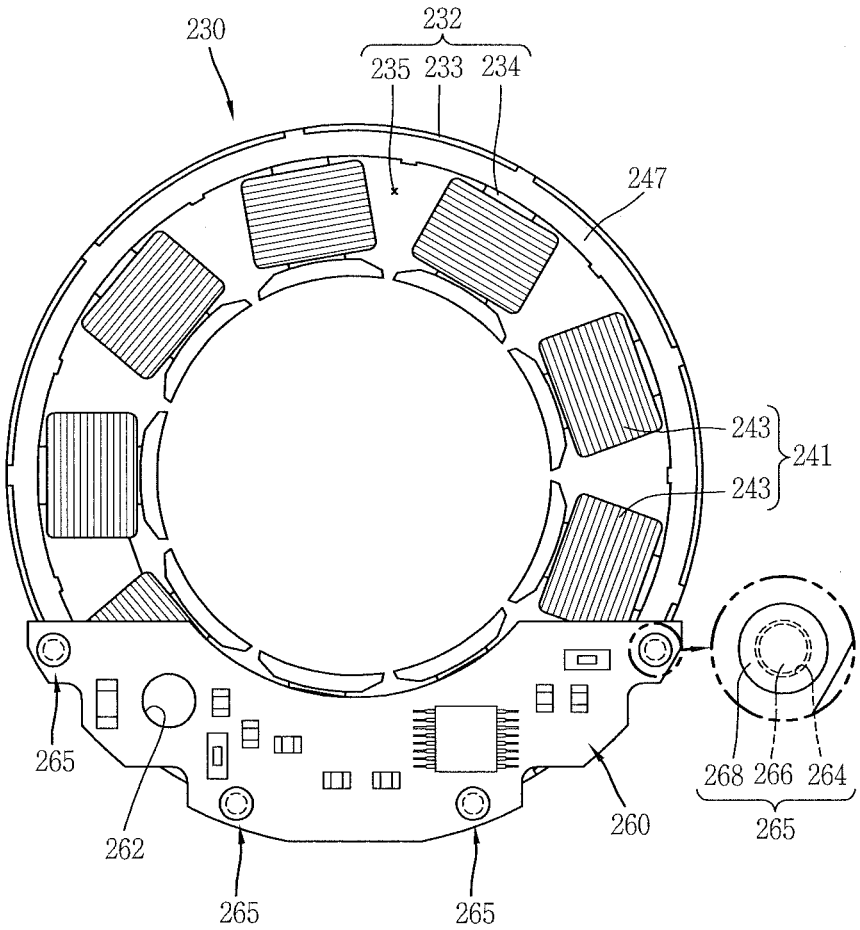
FIG. 3 is a diagram illustrating an example stator.

FIG. 3 illustrates an example stator. The printed circuit board 260, for example, may be formed in an arcuate shape.

A coupling rod accommodating hole 262 may be formed through the printed circuit board 260 such that a coupling rod 221 to be explained later is accommodated therein.

Fixing portions 265 for preventing a relative movement between the stator 230 and the printed circuit board 260 may be provided between the stator 230 and the printed circuit board 260.

Each of the fixing portions 265, for example, may be provided with a fixing pin 266 provided at the stator 230, and a fixing pin hole 264 provided at the printed circuit board 260.

The fixing pin 266, for example, may be provided at the stator core 232.

The fixing pin 266 may be made of a metal, e.g., copper (Cu).

The fixing pin 266, for example, may be configured such that one side thereof is press-fit into the stator core 232.

The printed circuit board 260 may be provided with the fixing pin hole 264 in which the fixing pin 266 is inserted.

A bonded portion 268 at which the fixing pin 266 and the printed circuit board 260 are integrally bonded to each other may be formed at an end portion of the fixing pin 266 inserted in the fixing pin hole 264.

The bonded portion 268, for example, may be formed in a manner of soldering the fixing pin 266 and the printed circuit board 260 with each other.

In some implementations, the fixing portion 265 is provided by four, but the number of the fixing portion 265 may be appropriately adjustable.

Meanwhile, the case 180, for example, may include a first body 181 and a second body 201 coupled to each other in a surface-contacting manner to define an accommodation space therein, and coupling rods 221 protruding from one of the first body 181 and the second body 201 and inserted through the stator 230 to be coupled to another one of the first body 181 and the second body 201.

The case 180, for example, may include a first body 181 and a second body 201. The first body 181 and the second body 201 are coupled to each other in a surface-contacting manner configured to define an accommodation space therein.

Figure 4:
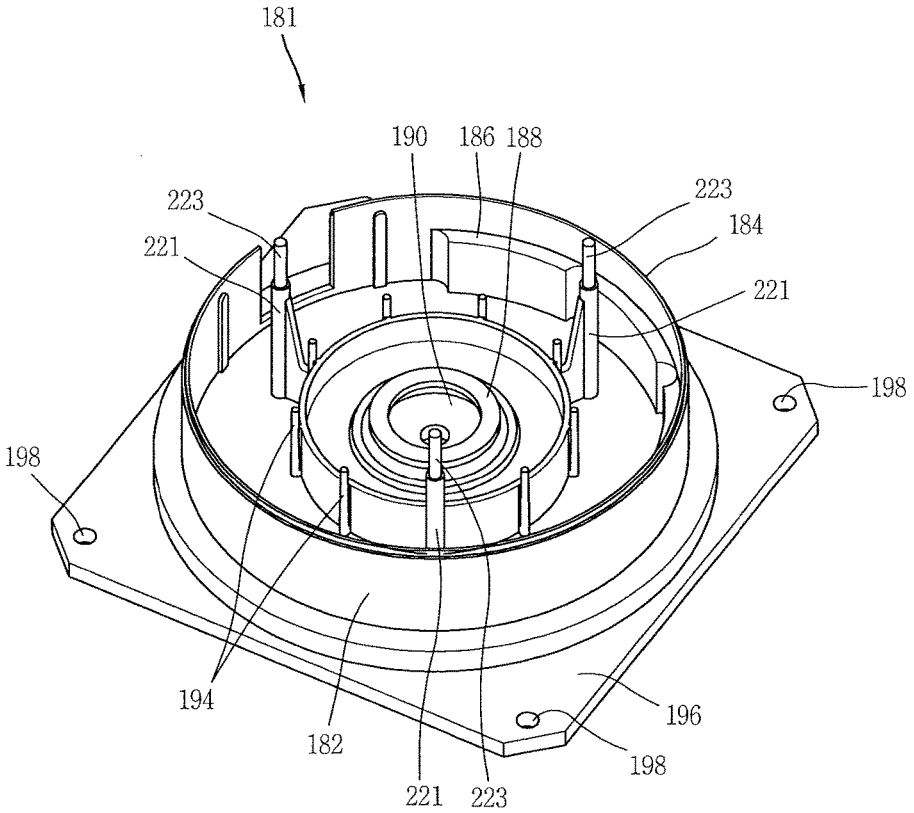
FIG. 4 is a diagram illustrating an example first body.

FIG. 4 illustrates an example first body of a case. The first body 181, for example, may define therein a cylindrical accommodation space with one side open.

The first body 181 may be provided with a cylindrical portion 182 defining a cylindrical accommodation space therein.

The first body 181, for example, may be provided with an insertion rib 184 inserted into the second body 201.

The insertion rib 184 may be formed in a stepped manner to have a more reduced outer diameter than an outer diameter of the cylindrical portion 182.

The first body 181 may include a stator supporting portion 186 for supporting the stator 230.

The stator supporting portion 186 of the first body 181, for example, may protrude from an inner surface of the cylindrical portion 182 in a radial direction and extend in a circumferential direction.

The stator supporting portion 186 of the first body 181, for example, may have an arcuate shape.

The first body 181, for example, may include a bearing 190 for supporting the rotational shaft 252.

The bearing 190 may include a rotational shaft opening 192 which is provided at a center thereof and in which the rotation shaft 25 is inserted.

The bearing 190, for example, may have a spherical shape whose both ends are evenly cut off along an axial direction.

The first body 181 may be provided with a bearing accommodating portion 188 in which the bearing 190 is inserted.

The first body 181, for example, may include guides 194 which protrude from a circumference of the bearing accommodating portion 188.

The guides 194, for example, may be implemented into a shape of a circular bar.

The guides 194, for example, may protrude in an axial direction of the bearing accommodating portion 188 and be spaced apart from one another along a circumferential direction of the bearing accommodating portion 188.

The guides 194, for example, may be formed to be located between the adjacent poles 234 of the stator 230, respectively.

This structure may allow the stator 230 to be coupled into the first body 181 at a preset accurate position.

The first body 181, for example, may include a first coupling portion (joint part) 196 which is provided at one side of the cylindrical portion 182 and more extends than the outer diameter of the cylindrical portion 182.

The first coupling portion 196, for example, may be located at an outer side of the hub 161.

The first coupling portion 196, for example, may be brought into a surface-contact with the support plate 270.

The first coupling portion 196, for example, may be implemented into a shape of a rectangular plate.

The first coupling portion 196, for example, may be provided with coupling member insertion holes 198 through which coupling members 199 are inserted to couple the first body 181 and the support plate 270 to each other.

The coupling member insertion holes 198, for example, may be formed at edge areas of the first coupling portion 196, respectively.

Figure 5:
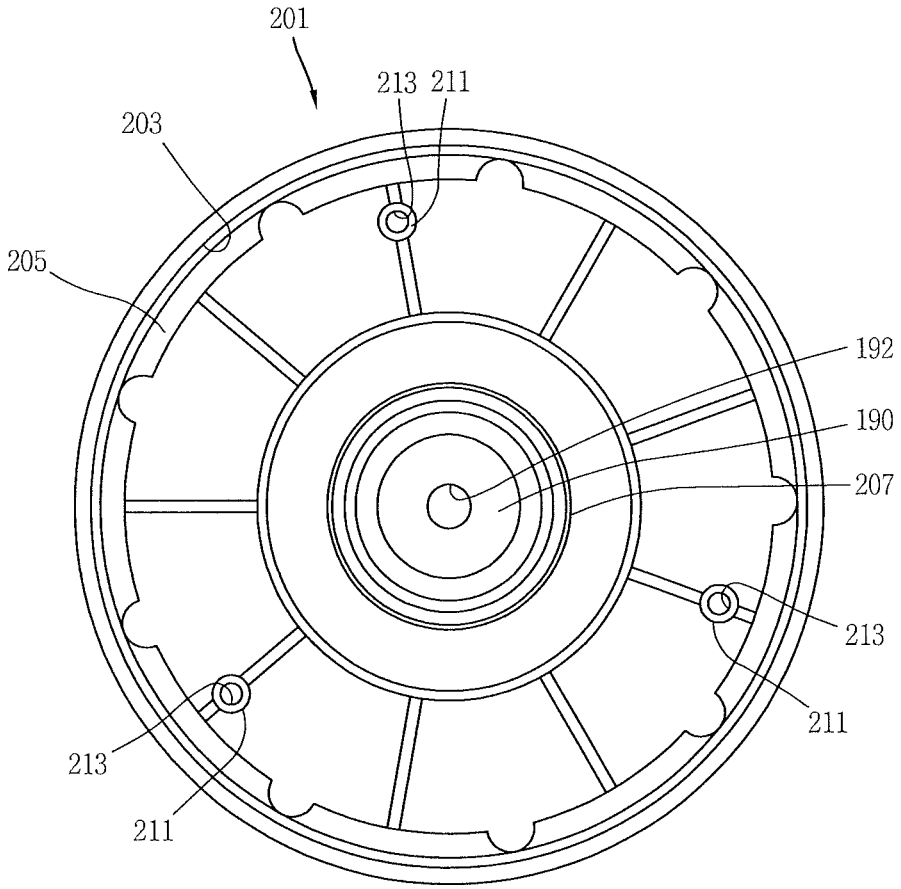
FIG. 5 is a diagram illustrating an example second body.

FIG. 5 illustrates an example second body of a case. The second body 201, for example, may form a circular accommodation space therein with one side open.

The second body 201, for example, may include an accommodating portion 203 in which the insertion rib 184 of the first body 181 is inserted.

The accommodating portion 203 of the second body 201, for example, may be cut off in a manner that an inner diameter of the second body 201 extends in a radial direction and extend along a circumferential direction.

The accommodating portion 203 of the second body 201, for example, may have a depth (height) corresponding to a height of the insertion rib 184 of the first body 181.

The second body 201, for example, may include a stator supporting portion 205 which comes in contact with the stator 230 to support the stator 230.

The stator supporting portion 205 of the second body 201, for example, may be formed in a manner of protruding from an inner surface of the second body 201 in a radial direction and extending in a circumferential direction.

The stator supporting portion 205 of the second body 201, for example, may have an arcuate shape.

The second body 201, for example, may include a bearing 190 for supporting the rotational shaft 252.

The bearing 190, for example, may have a spherical shape whose both ends are evenly cut off along an axial direction.

The second body 201 may be provided with a bearing accommodating portion 207 in which the bearing 190 is inserted.

Meanwhile, the case 180 may include coupling rods 221 which protrude from one of the first body 181 and the second body 201 and are coupled to another one of the first body 181 and the second body 201.

The coupling rods 221, for example, as illustrated in FIG. 4, may be formed on the first body 181.

The coupling rods 221, for example, may be provided by three.

The coupling rods 221, for example, may be spaced apart from one another along a circumferential direction of the first body 181 with an equal interval.

The coupling rods 221, for example, may have a shape of a circular bar. Each of the coupling rods 221, for example, may include an insertion end portion 223 inserted into the second body 201.

The insertion end portion 223 may be formed at an end area (upper portion) of the coupling rod 221.

The insertion end portion 223, for example, may have a more reduced outer diameter than that of a lower portion (main body) of the coupling rod 221.

The second body 201 may include boss portions 211 to which the coupling rods 221 are coupled.

The boss portions 211, for example, may protrude from an inner surface of the second body 201 in an axial direction.

Each of the boss portions 211 may be provided with a coupling rod accommodating hole 213 formed therethrough, such that the coupling rod 221 is inserted into the coupling rod receiving hole 213.

Meanwhile, the case 180 and the support plate 270, for example, may be provided with an engagement portion 280 by which the case 180 and the support plate 270 are engaged with each other in a manner of being perpendicular to an axial direction.

Figure 6:
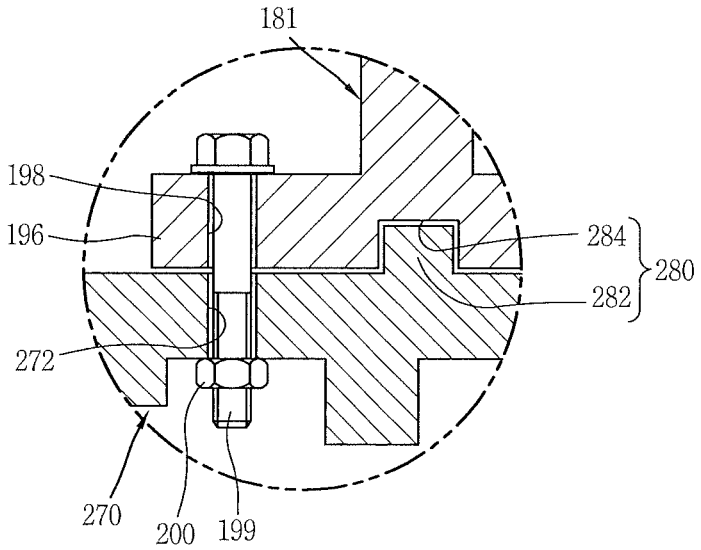
FIG. 6 is a diagram illustrating an example area of a second coupling portion.

FIG. 6 illustrates an example area of a second coupling portion. The engagement portion 280, for example, may include a protrusion 282 which protrudes from one of contact surfaces of the case 180 and the support plate 270, and a protrusion accommodating portion 284 which is formed at another one of the contact surfaces of the case 180 and the support plate 270 such that the protrusion 282 is inserted therein.

This configuration may prevent the case 180 and the support plate 270 from being relatively moved perpendicular to an axial direction.

This may result in reducing coupling places for the coupling members (bolts or screws) 199 to couple the case 180 and the support plate 270.

Accordingly, the number of required coupling points or spots, such as the coupling members 199, e.g. bolts and nuts, nuts 200 and the like, for coupling the case 180 and the support plate 270 may be reduced.

Also, a coupling time of the case 180 and the support plate 270 may be shortened.

The protrusion 282, for example, may be formed at the support plate 270.

The protrusion 282, for example, may protrude from a plate surface of the support plate 270 and extend in a circumferential direction of the case 180.

The protrusion accommodating portion 284 may be formed at the first body 181.

The protrusion accommodating portion 284, for example, may be recessed into one side (a lower surface in the drawing) of the first body 181.

Figure 7:
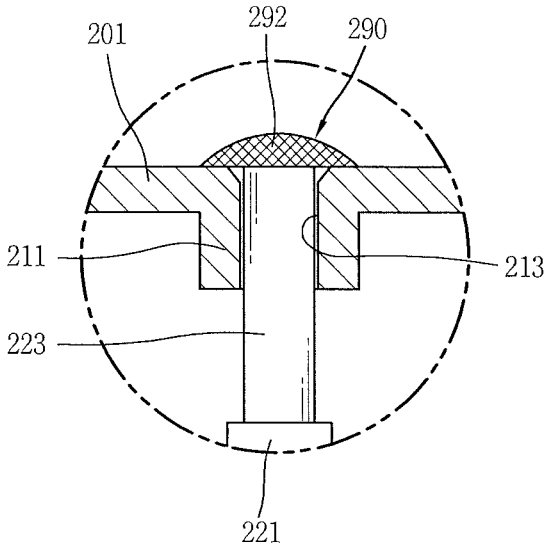
FIG. 7 is a diagram illustrating an example area of an engagement portion.

FIG. 7 illustrates an example area of an engagement portion. For example, the second body 201 may include a second coupling portion 290 which allows the second body 201 to be coupled to the coupling rod 221.

The second coupling portion 290, for example, may include a melted portion(fusions or welds) 292 which is melted and coupled to the second body 201 by heating an end (an end portion) of the coupling rod 221 protruding to the exterior of the second body 201.

In some implementations, the second coupling portion 290 includes three melted portions 292, but the number of the melted portion 292 may be adjustable according to the number of coupling rods 221.

This configuration may allow for reducing a gap between the hub 161, e.g., an inner surface of the hub 161, and the case 180.

Explaining this in more detail, a gap between the blocking section 162*b* of the hub 161 and the case 180 can be reduced. Accordingly, supposing the same length of the hub 161, an axial length of the case 180 can be increased.

This may increase an axial length of the motor 170 (the stator 230 and the rotor 250), thereby improving an output of the motor 170.

Also, supposing the same axial length of the motor 170, an axial length of the hub 161 may be reduced by that much, which may result in a reduction of an axial length of the fan-motor assembly 150.

The fan-motor assembly 150 can have a reduced axial length, thereby reducing a back-and-forth thickness (width) of the cool air circulation passage 130.

Accordingly, a back-and-forth width of a real food storage space of the storage chamber 120 can be increased.

Figure 8:
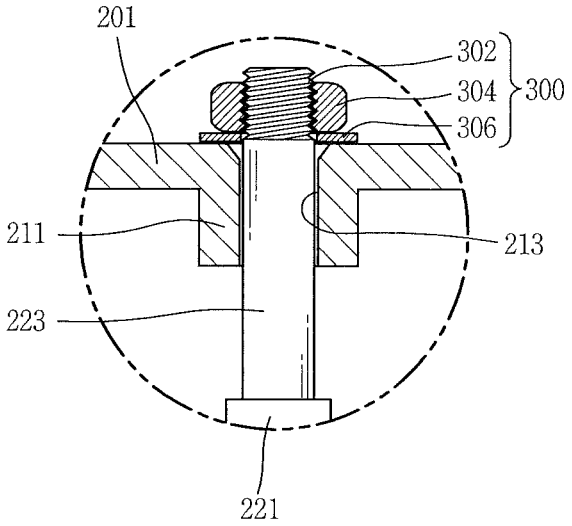
FIG. 8 is a diagram illustrating another example second coupling portion.

FIG. 8 illustrates another example second coupling portion. For example, the second coupling portion 300 may include the male screw 302 formed at the end area of the coupling rod 221, and the nut 304 coupled to the male screw 302.

The coupling rod 221 may protrude from an outer surface of the second body 201.

The male screw 302 may be formed at the protruded end portion of the coupling rod 221.

The male screw 302 may be coupled with the nut 304 in a screwing manner.

A washer 306 may be interposed between the nut 304 and the second body 201.

Figure 9:
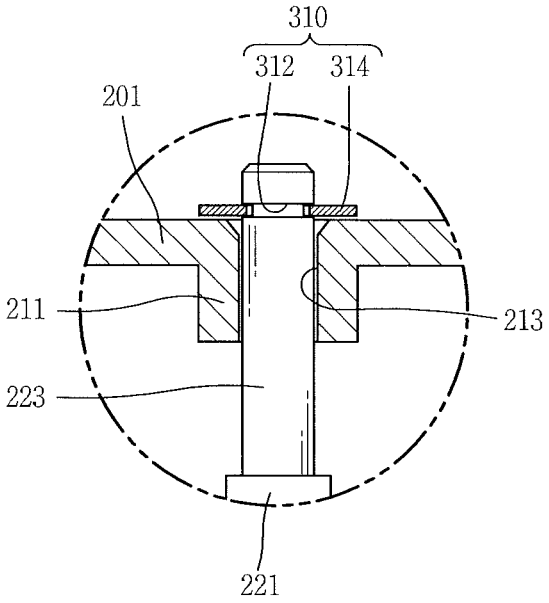
FIG. 9 is a diagram illustrating another example variation of a second coupling portion.

FIG. 9 illustrates another example second coupling portion. The second coupling portion 310 may include a snap ring 314 coupled to an end portion of the coupling rod 221.

The coupling rod 221 may protrude from an outer surface of the second body 201.

A concave-convex portion 312, for example, may be formed at an end area of the coupling rod 221.

The snap ring 314 may be coupled to the concave-convex portion 312.

With the configuration, when desiring to assemble the fan-motor assembly 150, first, the fixing pins 266 may be press-fit into the stator core 232.

Referring back to FIG. 3, the printed circuit board 260 may be coupled to the fixing pins 266.

The bonded portion 268 may be formed at an end portion of each fixing pin 266 inserted into the fixing pin hole 264 of the printed circuit board 260.

Accordingly, the printed circuit board 260 may be integrally coupled to the stator 230, resulting in preventing a relative movement thereof.

The stator 230 may be inserted into the first body 181.

In this example, the coupling rods 221 of the first body 181 may be coupled by being inserted into the empty spaces between the adjacent coil portions 243 of the stator 230.

The stator 230 may be mounted in the stator supporting portion 186 of the first body 180 and supported.

The rotor 250 may be coupled into the stator 230.

The rotational shaft 252 of the rotor 250 may be inserted into the bearing 190 of the first body 181.

The second body 201 may be coupled to the first body 181.

The rotational shaft 252 may be inserted into the bearing 190 of the second body 201.

The insertion end portions 223 of the coupling rods 221 may be coupled to the boss portions 211 of the second body 201, respectively.

The stator support portion 205 of the second body 201 may come in contact with an upper surface of the stator 230.

Accordingly, the stator 230 may be supported in an axial direction by the stator supporting portion 186 of the first body 181 and the stator supporting portion 205 of the second body 201, respectively. This may result in preventing a generation of a clearance.

Meanwhile, the insertion end portion 223 of each coupling rod 221 inserted through the second body 201 may be melted and coupled on the second body 201 in a heating manner configured to form the melted portion 292.

Accordingly, the first body 181 and the second body 201 may be firmly coupled to each other.

The rotational shaft 252 protruding to the exterior of the second body 201 may be inserted into the shaft accommodating portion 164 of the fan 160.

The pressing member 165 may be coupled to an outer surface of the shaft accommodating portion 164.

The case 180 may be coupled to the support plate 270.

The protrusion 282 of the support plate 270 may be inserted into the protrusion accommodating portion 284 formed at the case 180 (the first body 181).

The coupling members 199, for example, screws or bolts, may be inserted into the coupling member insertion holes 198 of the case 180, for example, the first body 181, and the through holes 272 of the support plate 270, which communicate with each other, and the nuts 200 may be coupled to the coupling members 199, respectively, in a screwing manner.

This may allow the case 180 to be integrally coupled to the support plate 270.

The fan-motor assembly 150 may be disposed in the cool air circulation passage 130 of the refrigerator main body 110.

When the fan-motor assembly 150 starts to rotate, cool air within the storage chamber 120 may be introduced through the cool air introduction opening 132 of the cool air circulation passage 130.

The fan-motor assembly 150 may prevent a generation of vibration and noise due to the permanent magnet 254 during driving, because the permanent magnet 254 of the rotor 250 is spaced apart from the hub 161 of the fan 160.

The cool air introduced in the cool air circulation passage 130 through the cool air introduction opening 132 may flow upward and come in contact with the evaporator 135 configured to be heat-exchanged.

The cool air which has been cooled by heat-exchanging with the evaporator 135 may be discharged to the storage chamber 120 through the cool air discharge opening 134, thereby cooling the storage chamber 120.

The cool air which has cooled the storage chamber 120 is then introduced back into the cool air introduction opening 132. Such series of processes may be repeated to continuously cool the storage chamber 120.

As described above, a case of a motor provided in a hub may have a cylindrical shape, which may result in reducing a gap between the hub and the case and prevent interference between the hub and the case.

The reduced gap between the case and the hub may allow for an increase in a real size of the case in the hub, configured to increase sizes of a stator and a rotor within the case, thereby raising an output of the motor, supporting the same size of the hub.

Coupling rods for coupling a first body and a second body of the case are inserted through the stator (between adjacent stator coils), configured to prevent a reduction of real sizes of the case and the motor, which may result in preventing an output of the motor from being lowered due to the reduced size of the motor.

An outer surface of the case may be configured adjacent to an inner surface of the hub, which may prevent a reduction of a real size of the motor, which is caused due to a reduced size of the case. This may result in preventing the output of the motor from being lowered.

With each coupling rod being melted, a protruded length of the coupling rod protruding from the outer surface of the case may be reduced, which may result in preventing an increase in an axial length of the hub.

The melding of each coupling rod with the case may prevent an axial length of the case from being substantially reduced to ensure the protruded length of the coupling rod, thereby preventing an output of the motor from being lowered due to the reduced size of the motor.

A printed circuit board may be provided at one side (a lower side) of a stator in the case, and accordingly a separate accommodation space of the printed circuit board may not be required at an outside of the case, thereby preventing a reduction of a real size of the motor.

Fixing portions for fixing the stator and the printed circuit board may be provided, thereby preventing an electric disconnection of a control circuit of the printed circuit board, which results from a slack of the printed circuit board.

The case and a support plate may be provided with an engagement portion configured to be engaged with each other in a manner of being horizontal with respect to an axial direction. This may result in reducing a number of places for coupling the case and the support plate, thereby reducing a number of components required and an assembling (or coupling) time.

What is claimed is:

1. A fan-motor assembly comprising:

a fan including a hub and a plurality of blades, the hub having a first accommodation space and the plurality of blades being disposed outside the hub;

a motor including a stator and a rotor, the motor located in a case, the case having a cylindrical shape and being disposed in the hub, the stator being disposed in the case, and the rotor having a rotational shaft coupled to the hub and being rotatably disposed in the stator;

a support plate that is coupled to the case and that is configured to support the fan and the motor; and a printed circuit board provided in the case, and having a control circuit configured to control a rotation of the rotor, wherein the stator comprises:

a stator core defining, in the stator core, a rotor accommodation space in which the rotor is inserted, and having a plurality of poles and slots protruding toward the rotor accommodating space, and stator coils wound on a respective circumference of each of the plurality of poles, wherein coupling rods are inserted into empty spaces between adjacent stator coils, and wherein the printed circuit board is disposed between the stator core and the case.

2. The assembly of claim 1, wherein the case comprises:

a first body; and a second body coupled to the first body in an axial direction and configured to define a second accommodation space in the second body, the second body contacting a surface of the first body, wherein the coupling rods protrude from one of the first body and the second body, the coupling rods being coupled to the other of the first body and the second body.

3. The assembly of claim 2, wherein each of the coupling rods protrudes from the first body and is inserted into the second body, and wherein the second body is provided with a coupling portion, the coupling portion allowing the second body to be coupled to the coupling rods.

4. The assembly of claim 3, wherein the coupling portion comprises melted portions of the second body at which end portions of the coupling rods are melted onto the second body for coupling.

5. The assembly of claim 3, wherein the first body is disposed at an open side of the hub, and wherein the first body and the support plate are provided with an engagement portion by which the first body and the support plate are engaged with each other in an axial direction.

6. The assembly of claim 5, wherein the engagement portion comprises a protrusion protruding from one of the first body and the support plate; and a protrusion accommodating portion located at the other of the first body and the support plate such that the protrusion is inserted into the protrusion accommodating portion.

7. The assembly of claim 5, wherein the first body further comprises a joint part coupled to the support plate.

8. The assembly of claim 2, wherein each of the first body and the second body comprises stator supporting portions, the stator supporting portions being respectively in contact with an edge of the stator to support the stator.

9. The assembly of claim 8, wherein the stator supporting portions protrude from inner surfaces of the first body and the second body, respectively, and extend along a circumferential direction of the first body and the second body.

10. The assembly of claim 1, wherein the case is provided with a bearing to support the rotational shaft.

11. The assembly of claim 1, wherein the printed circuit board is provided with coupling rod accommodating holes through which the coupling rods are inserted.

12. The assembly of claim 1, further comprising fixing portions to fix the stator and the printed circuit board.

13. The assembly of claim 12, wherein each of the fixing portions comprises:

a fixing pin provided at the stator core;

a fixing pin hole located at the printed circuit board and configured to receive the fixing pin; and a bonded portion located at an end portion of the fixing pin and inserted in the fixing pin hole.

14. A refrigerator comprising:

a refrigerator main body having a storage chamber;

a cool air circulation passage along which cool air of the storage chamber circulates; and a fan-motor assembly circulating the cool air, wherein the fan-motor assembly comprises:

a fan including a hub and a plurality of blades, the hub having a first accommodation space and the plurality of blades being disposed outside the hub;

a motor including a stator and a rotor, the motor located in a case, the case having a cylindrical shape and being disposed in the hub, the stator being disposed in the case, and the rotor having a rotational shaft coupled to the hub and being rotatably disposed in the stator;

a support plate that is coupled to the case and that is configured to support the fan and the motor; and a printed circuit board provided in the case, and having a control circuit configured to control a rotation of the rotor, wherein the stator comprises:

a stator core defining, in the stator core, a rotor accommodation space in which the rotor is inserted, and having a plurality of poles and slots protruding toward the rotor accommodating space, and stator coils wound on a respective circumference of each of the plurality of poles, wherein coupling rods are inserted into empty spaces between adjacent stator coils, and wherein the printed circuit board is disposed between the stator core and the case.

15. The refrigerator of claim 14, wherein the case comprises:

a first body; and a second body coupled to the first body in an axial direction and configured to define a second accommodation space in the second body, the second body contacting a surface of the first body, wherein the coupling rods protrude from one of the first body and the second body, the coupling rods being coupled to the other of the first body and the second body.

16. The refrigerator of claim 15, wherein each of the coupling rods protrudes from the first body and is inserted into the second body, and wherein the second body is provided with a coupling portion, the coupling portion allowing the second body to be coupled to the coupling rods.

17. The refrigerator of claim 16, wherein the coupling portion comprises melted portions of the second body at which end portions of the coupling rods are melted onto the second body for coupling.

18. The refrigerator of claim 16, wherein the first body is disposed at an open side of the hub, and wherein the first body and the support plate comprise an engagement portion to be engaged with each other in an axial direction.

* * * * *